United States Patent [19]

Orii

[11] 4,381,170

[45] Apr. 26, 1983

[54] REVERSING DEVICE FOR PRESS WORKED GOODS

[75] Inventor: Masaru Orii, Machida, Japan

[73] Assignee: Kabushiki Kaisha Orii Jidoki Seisakusho, Tokyo, Japan

[21] Appl. No.: 293,183

[22] Filed: Aug. 17, 1981

[51] Int. Cl.[3] ..... B65G 47/24

[52] U.S. Cl. ..... 414/758; 198/403

[58] Field of Search ..... 198/402, 403, 409, 750; 414/758; 269/55, 71, 73; 271/186, DIG. 9, 65, 66, 70, 83

[56] References Cited

U.S. PATENT DOCUMENTS 2,154,476 4/1939 Simpson et al. ..... 198/403

FOREIGN PATENT DOCUMENTS 177902 4/1960 Sweden ..... 198/403

*Primary Examiner*—Jeffrey V. Nase
*Assistant Examiner*—Jonathan D. Holmes
*Attorney, Agent, or Firm*—Darby & Darby

[57] ABSTRACT

A reversing device for press worked goods which is to be arranged between presses in the secondary press working line, wherein the press worked goods are reversed by 180° for next pressing process. The reversing device comprises in combination a slide base, a slider attached to the slide base, a reverse plate rotatably supported on the slider, a reversing drive apparatus for reciprocatively rotating said reversng plate and a straightway drive apparatus for reciprocative movement of the slider.

1 Claim, 4 Drawing Figures

REVERSING DEVICE FOR PRESS WORKED GOODS

BACKGROUND OF THE INVENTION

In general, a reversing device for press worked goods is arranged between presses in the secondary press working line. An attraction arm of a take up and supply means for press worked goods takes up the goods from metallic dies of a press and convey them to the reversing device for press worked goods, then the device will reverse the goods by 180° and the attraction arm will supply the goods to a next press. However, usual reversing device for press worked goods has adopted such a structure as to reverse the goods in the feed direction thereof around an end of goods, so that the position of the goods will change before and after the reversing. Accordingly, the stroke of attraction arm of the take up and supply means for the press worked goods must be differently determined between a press of the first process and the reversing device for press worked goods, as well as between the reversing device and a press of the second process, thus the countermeasure to the cases were difficult when the dimension of press worked goods in feed direction was changed and when the reversing of press worked goods became needless.

SUMMARY OF THE INVENTION

This invention relates to a reversing device for press worked goods, wherein the goods are reversed by 180° for next press working.

The object of this invention is to provide a reversing device for press worked goods, wherein the positions of press worked goods can be made identical before and after the reversing.

DESCRIPTION OF THE PREFERRED EMBODIMENT

Figure 4:
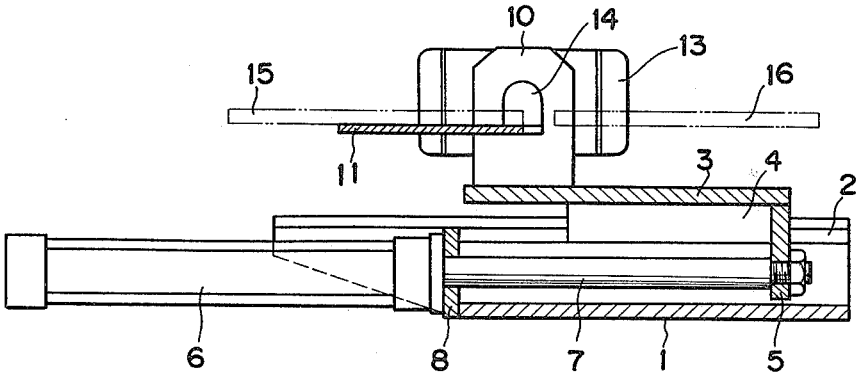
FIG. 4 is a sectional view along B—B line of FIG. 1.

A slide base (1) is fixed to the bolster and the like of a press by means of mounting members (not shown), having sliding guides (2) on both sides of the base. A sliding member (4) fixed to a slider (3) is slidably engages with the sliding guide (2). A connection plate (5) (FIG. 4) is fixed to the slider (3) and is connected to a piston rod (7) of an air cylinder (6). The air cylinder (6) moves the slider (3) reciprocatively along the sliding guides (2), and constitutes one example of the straightway drive means of this invention. The air cylinder (6) is fixed to a mounting plate (8) provided on the slide base (1). A bearing plate (9) and a supporting plate (10) are fixed on the slider (3). One of axis portion (12) of a reversing plate (11) is rotatably supported on the bearing plate (9). A rotation actuator (13) is mounted on the supporting plate (10) and the rotation axis of the rotation actuator (13) rotatably penetrates the supporting plate (10) and is connected to another axis portion (14). The axis portion (12) and the axis portion (14) are provided on both sides of front end of the reversing plate (11), thus a line connecting the axis portions (12) and (14) becomes a central axis of rotation. The rotation actuator (13) reciprocatively rotates the reversing plate (11) by 180° and constitutes one example of the reversing drive means of this invention.

A jig plate (15) shown by a two-dot chain line is fixed on the reversing plate (11). The jig plate (15) is shown in planar shape, however, those of various shapes will be used corresponding to the shapes of press worked goods. A receiving plate (16) shown by a two-dot chain line is fixed on the slider (3) by means of a supporting member (17). The receiving plate (16) receives press worked goods to be reversed by the reversing plate (11), and those of various shapes will be used corresponding to the shapes of press worked goods similarly to the jig plate (15).

Figure 1:
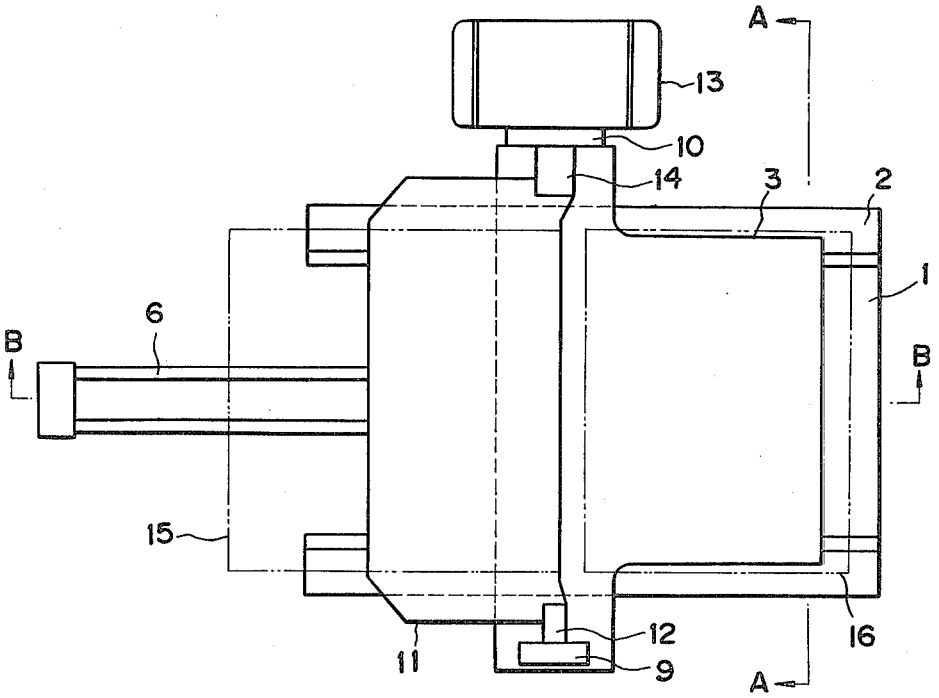
FIG. 1 is a plan view of an embodiment of this invention.
Figure 2:
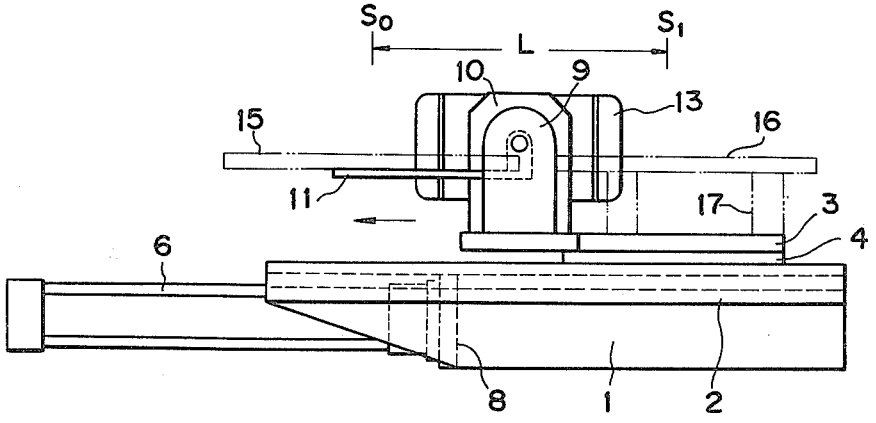
FIG. 2 is a front view of FIG. 1.
Figure 3:
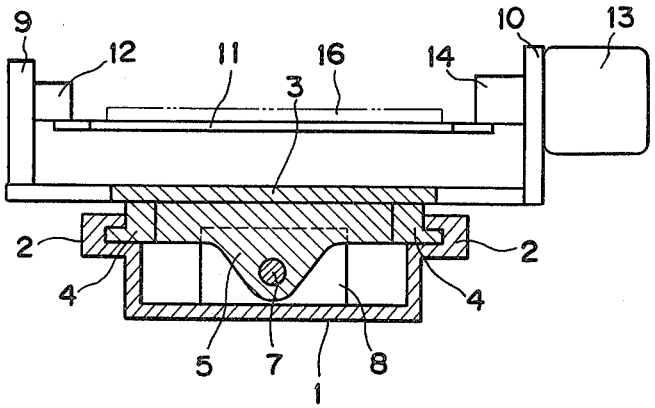
FIG. 3 is a sectional view along A—A line of FIG. 1.

The slide base (1) is arranged in such a manner that the central position So of press worked goods shown in FIG. 2 will lie between two presses. The press worked good worked by the press in precedent process are conveyed onto the jig plate (15) by means of the attraction arm of the take up and supply device for press worked goods and the center of the goods coincides with the central position So of press worked goods. When the rotation actuator (13) is operated to rotate the reversing plate (11) by 180° in the direction of arrow in FIG. 2, the press worked goods on the jig plate (15) are reversed by 180° and put on the receiving plate (16). The center of press worked goods on the receiving plate (16) is located at a central position $S_1$ after reversing, and the press worked goods are moved by a distance L in the feed direction of the goods (from left to right in FIG. 1) by the reversing. This invention is characterized in that after reversing or during reversing, the slider (3) is moved back by a distance L by the operation of the air cylinder (6). Due to the moving back of the slider (3) by a distance L. The center of press worked goods returns to the central position So of press worked goods, i.e. returns to a position between the first and the second presses, so that the attraction arm of the take up and supply device for press worked goods can supply the goods to the press of the second process with the same stroke as at the time of taking up the goods from the press of the first process.

The rotation actuator (13) will immediately return to the original state upon the reversing of the press worked goods to put the reversing plate (11) and the jig plate (15) back in their original position. After the pressed goods are supplied from the receiving plate (16) to the press of the second process, the air cylinder (6) will return to the original state to put the slider (3) back in its original position.

In this invention, since the reversing plate is provided on the slider and the slider is made to move by a distance necessary for restoring the position of the press worked goods changed due to the reversing by means the reversing plate, the position of the press worked good can be made identical before and after reversing.

What is claimed is:

1. A reversing device for press worked goods, comprising in combination a slide base having sliding guides along the feed direction of press worked goods, a slider attached to said slide base movably guided by said sliding guides, a reversing plate provided on the front end of said slider and rotatably supported around a central axis of rotation at right angle to the feed direction of press worked goods, a reversing drive means for reciprocatively rotating said reversing plate by 180°, and a straightway drive means for reciprocative movement of said slider along said sliding guides by a distance necessary for restoring the position of press worked goods changed by the reversing due to said reversing plate.

* * * * *